US006523448B1

(12) United States Patent
Chang

(10) Patent No.: US 6,523,448 B1
(45) Date of Patent: Feb. 25, 2003

(54) ADAPTABLE HYBRID MODULE DIE BOARD

(76) Inventor: Long Chang, 7 Wickland, Irvine, CA (US) 92620

( * ) Notice: Subject to any disclaimer, the term of this patent is extended or adjusted under 35 U.S.C. 154(b) by 63 days.

(21) Appl. No.: 09/668,778

(22) Filed: Sep. 22, 2000

(51) Int. Cl.[7] ..... B26D 7/26
(52) U.S. Cl. ..... 83/698.31; 83/653; 83/699.11
(58) Field of Search ..... 83/698.71, 699.11, 83/698.31, 653, 128, 652–657; 76/107.8

(56) References Cited

U.S. PATENT DOCUMENTS

| | | | | | |
|---|---|---|---|---|---|
| 1,260,820 | A | * | 3/1918 | Scott | 83/652 |
| 2,458,867 | A | * | 1/1949 | Messersmith | 83/657 |
| 3,012,451 | A | * | 12/1961 | Koher | 76/107.8 |
| 3,263,547 | A | * | 8/1966 | Pfaff, Sr. et al. | 83/567 |
| 3,383,969 | A | * | 5/1968 | Saunders | 83/656 |
| 3,635,115 | A | | 1/1972 | Richkenbacker | |
| 3,673,929 | A | | 7/1972 | Sauders | |
| 3,752,042 | A | | 8/1973 | Castille | |
| 3,826,170 | A | | 7/1974 | Jones et al. | |
| 3,835,746 | A | | 9/1974 | Young, Jr. et al. | |
| 3,929,059 | A | | 12/1975 | Gendron | |
| 3,941,038 | A | | 3/1976 | Bishop | |
| 4,020,724 | A | | 5/1977 | Quinlan | |
| 4,103,580 | A | | 8/1978 | Sauer et al. | |
| 4,351,210 | A | * | 9/1982 | McKindary | 83/835 |
| D274,335 | S | | 6/1984 | Jenkins | |
| 4,675,158 | A | | 6/1987 | Bittner | |
| 4,945,751 | A | | 8/1990 | Ireland | |
| 4,981,060 | A | | 1/1991 | Knudson | |
| 5,029,505 | A | | 7/1991 | Holliday | |
| 5,129,295 | A | * | 7/1992 | Geffros et al. | 83/19 |
| 5,221,249 | A | | 6/1993 | Simpson | |
| 5,275,076 | A | * | 1/1994 | Greenwalt | 83/698 |
| 5,293,799 | A | | 3/1994 | Ury | |
| 5,333,519 | A | * | 8/1994 | Holliday et al. | 76/107.8 |
| 5,566,594 | A | | 10/1996 | Michlin | |
| 5,582,571 | A | | 12/1996 | Simpson et al. | |
| 5,676,032 | A | | 10/1997 | Johnson | |
| 5,743,164 | A | | 4/1998 | Guez | |
| 5,943,935 | A | | 8/1999 | Brayton et al. | |
| 5,983,766 | A | | 11/1999 | Johnson | |
| 6,209,436 | B1 | * | 4/2001 | Smithwick | 83/699.11 |

* cited by examiner

*Primary Examiner*—Kenneth E. Peterson
*Assistant Examiner*—Omar Flores-Sánchez

(57) ABSTRACT

A die board assembly includes a support plate providing a plurality of through holes arranged along lines of an X-Y grid pattern. The support plate further provides a plurality of shaped apertures positioned within the support plate to a selected depth. One of the apertures is positioned between each pair of the through holes, the apertures providing aperture legs coincident with the lines of the X-Y grid. A plurality of rigid cylindrical receivers are adapted for engagement within one of the through holes and a plurality of resilient bumpers, are engaged within the cylindrical receivers for support thereof, each of the bumpers being segmented into a plurality of segments with segment spaces in separation thereof. A plurality of elongate blades each provide a working edge and in opposition thereto, an engagement edge, the engagement edge configured so as to engage a plurality of the shaped apertures and at least one of the resilient bumpers such that a terminal surface of the bumpers extends beyond the working edge of the blades relative to the support plate. Each elongate blade engages at least one of the segment spaces between the resilient bumper segments in support of the blade.

12 Claims, 4 Drawing Sheets

ADAPTABLE HYBRID MODULE DIE BOARD

BACKGROUND OF THE INVENTION

1. Field of the Invention

This invention relates generally to die board assemblies and more particularly to an easily adaptable die board assembly.

2. Description of the Related Art

The following art defines the present state of this field:

Jenkins, U.S. Pat. No. D274,335 describes the ornamental design for a die cutting apparatus.

Rickenbacker, U.S. Pat. No. 3,635,115 describes a punching device for cutting sheet-type layer pieces having mutually adjustable knife plates and means for adjusting the knife plates to cut pieces from the sheet of desired sizes.

Saunders, U.S. Pat. No. 3,673,929 describes a creasing rule for a rotary cutting die. The creating rule is used to produce and indented line in a corrugated board, along which line the corrugated board is to be folded subsequently, when formed into a final product, such as a container. The cutting die comprises a curved die plate fastened on a rotatable cylinder with the creasing rule mounted in the die plate. The new creasing rule includes a base or flange which extends through the die plate to contact and be backed up by the cylinder, which then positions the creasing rule at a fixed distance from the surface of the cylinder, even with a variation in the thickness of the die plate. Further, the creasing rule is designed with a broad tapered web on each side of an indenting ridge which produces the indented line, so that the possibility of breaking of the liner of the corrugated board when the indentation is made is minimized.

Castille, U.S. Pat. No. 3,752,042 describes a system of four arcuate dies are adapted to be mounted in evenly spaced threaded holes in a rotary cylinder for a cardboard box fabricating machine. The positions of three of the dies are adjustable either longitudinally or circumferentially, or both, on the rotary cylinder whereby the dimensions of the cardboard boxes manufactured may be varied infinitely. Further, the position of a single die plate on the rotary cylinder may be adjusted both longitudinally and circumferentially of the rotary cylinder to an infinite number of positions.

Jones et al., U.S. Pat. No. 3,826,170 describes a cutting blade system for cutting sheet material into pieces of generally the same contour but of different sizes, especially useful in the manufacture of apparel for cutting cloth into pieces to be sewn together into garments. The system involves a set of primary cutting blade segments common to all sizes of a piece of given contour or pattern to be cut out of the sheet material and a set of auxiliary cutting blade segments additive to (or subtractive from) the primary segments to constitute cutting blade assemblies of different sizes in the stated contour or pattern. The segments are made of steel rule die stock, are releaseably held together in assembly, and assemblies of segments in various patterns are utilized in a hydraulic press for die-cutting through one or more layers of material in the press. The press may have an electromagnetic head for magnetically gripping the assemblies for the cutting operation and for quickly releasing them after the cutting operation whereupon the assemblies may be disassembled and the primary segments reassembled with auxiliary segments in a different size.

Young, Jr. et al., U.S. Pat. No. 3,835,746 describes an improved die assembly having easily replaceable rule. A plate or roll directly receives on or more sections of rule according to a predeterined design or shape. The rule is thin elongated strip metal having a flat underside and an upperside that is sharp, radiused or otherwise prepared to perform a particular function on a material. The flat underside of the cutting rule is directly in contact with the backing plate or roll or a resilient cover positioned thereon. Removable, resilient mounting means apply a spring force against the rule to hold same against a rigid support in proper position for die cutting, creasing or the like. Removability of the resilient mounting means permits redy replacement of damaged or dulled cutting rule without any undue expense or appreciable production loss. Mounting means for the rule are also claimed, and include a rigid support and a resilient support to receive rule therebetween. The resilient support has at least one spring secured thereto and extending outwardly therefrom. The end of the support when in position defines the thickness of the rule and the spring system extends outwardly therefrom. The spring system is deformed by the rule upon insertion of the rule from above an continually applies a spring force against the rule to hold same in place.

Gendron, U.S. Pat. No. 3,929,059 describes a reusable make-ready or counter plate for cutting and scoring boxboard to form carton blanks. The reusable make-ready or counter plate comprises a mounting plate that is detachably mountable on the press and at least on cutting plate which is adapted to co-operate with knives and creasing rules on a male die to form a carton blank. The cutting plates are releaseably retained on the mounting plate.

Bishop, U.S. Pat. No. 3,941,038 describes a forme construction for a die cutting apparatus in which cutting rule is supported in slots in a relatively massive support plate by using sinuous resilient elements lying between walls of slots in the support plate and the sides of the rule.

Quinlan, U.S. Pat. No. 4,020,724 describes a rotary cutting die adapted to be mounted on a rotatable cylindrical die drum of a rotary press to cut a planar object passed between such rotating die drum and a cooperative oppositely-rotating anvil drum of said press. The rotary die includes: a die board having a concave surface adapted to cover a portion of the die drum, an opposite convex surface, and a plurality of openings therethrough; a plurality of fasteners adapted to selectively hold the die board to the die drum; a plate-like knife member adapted to be mounted on the die board at any of a plurality of large incremental positions in a longitudinal direction; and holding means mounted on the die board and selectively operable to hold the knife member at any selected one of the large incremental positions. In one embodiment, the die board openings are longitudinally-elongated to permit the die board to be shifted longitudinally relative to the die drum. In another embodiment, the die board openings are circumferentially-elongated and uniquely spaced from one another in a longitudinal direction such that some of the die board openings will register with some of the die drum holes at any of a plurality of discrete positions in a longitudinal direction. In this embodiment, compound movement of the die board and the knife member enables the knife edge to be selectively positioned along the die drum at any of a plurality of small incremental positions.

Sauer et al., U.S. Pat. No. 4,103,580 describes a method of and apparatus for developing on tape and applying a pre-selected die design, etc., defined by spaced drilled holes, to a die board automatically by a tape controlled apparatus, and to automatically produce properly dimensioned cutting rule for the design. A computer is programmed to produce information which is transferred to a tape, or the like, fed to a numerical control machine to energize selected mechanisms to physically apply a pre-selected design formed by spaced drilled holes, routing, etc., to a die board for reception of spaced tangs or legs of cutting rule, or the like, or other workings. The information from the computer also is utilized, by means of an intermediate tape or the like, to energize a numerically controlled cutting rule machine to automatically produce cutting rule segments of the proper number and length for mounting in the drilled design on the cutting board. Included in the computer programming is a foreshortening of dimensions, if required, to compensate for the relative position of the cutting rule edge in arcuate die boards. Illustrated is an exemplary apparatus for punching cutting rule and for drilling or drilling and routing rotary die board including an electrically actuatable structure for rotatably supporting rotary die board, an electrically actuatable traversable supporting structure for a drill head, and an electrically actuatable drill head adapted to execute desired reciprocable movements and to drill spaced holes and to rout, as signaled.

Bittner, U.S. Pat. No. 4,674,168 describes a method and a disc cutter machine for carrying out the method with which the previously strenuous blade receiver exchange is simplified and facilitated, it is provided that the blade receiver to be exchanged is tilted up by means of a tilting arrangement with its end facing the outer side of the disc cutter, received by a guide and drawn out substantially in the radial direction along the guide from the region of the disc cutter and then the new blade receiver is inserted along the guide into the disc cutter.

Ireland, U.S. Pat. No. 4,945,751 describes a portable reinforcing rod cutter and bender. A cutting die having elongate and oblique holes for receiving a plurality of rods to be sheared cooperates with a cutting blade connected to a hydraulically operated ram. A female bending die having a pair of pivoting die blocks cooperates with an anvil to bend rods of different diameter to bends having different angles and different diameters. The cutter and bender includes a first gauge for measuring bend angles and a second gauge for measuring the length of rods being bent or sheared. The cutting blade, cutting die, bending die, and anvil are readily removable to allow replacement thereof and to bend and shear different types and sizes of rods and pipes to different bend angles and bend diameters.

Knudson, U.S. Pat. No. 4,981,060 describes a roll forming apparatus having a series of roll forming stations with a first group of stations having rollers that are adjustable to different width settings using the same rollers to form more than one width of ogee type gutter. A cutter uses interchangeable cutting blades and die plates for shearing different gutter sizes to selected lengths. The cutter uses a rotary drive member to move the blade in a path having a relatively short stroke that performs a scissor-like cutting action to successively cut the walls of the formed gutters for each revolution of the rotary drive member. A crank member for manually moving the cutter blade is collapsible and the crank handle is demountable for transport purposes.

Holliday, U.S. Pat. No. 5,029,505 describes an apparatus having improved retention of steel rule dies inserted into slots of a retaining board. A plurality of chambers are oriented substantially perpendicularly to the direction of insertion and have open faces to permit communication with the slots. A spring is located within each chamber and is connected to a ball shaped member located at the open face. Upon initial insertion of the die, the ball shaped member causes the spring to compress. Once the die is completely inserted, the ball/spring assembly exerts a normal force against the die in the direction of the slot wall opposite the open face. Accordingly, the inserted steel rule dies are securely held within the slots.

Simpson, U.S. Pat. No. 5,221,249 describes a creasing rule used in connection with a steel rule cutting die to form creases or fold lines in a blank cut from a sheet material, such as corrugated paper board. The creasing rule includes a base portion which fits into the slot of a die board, and a top portion which extends outwardly from the surface of the die board. The top portion terminates in a creasing edge, which, in cooperation with an anvil roll, compresses the sheet material to form a crease or fold line in the sheet material. The creasing edge of the creasing rule is formed with a plurality of undulations giving the creasing edge a generally sinusoidal form. The undulations on the creasing rule taper inwardly towards the plane of the base portion as the undulations extend from the creasing edge towards the base portion and finally merge into the flat base portion. The size or magnitude of the undulations can be varied depending on the thickness of the sheet material being used. Additionally, the pitch of the undulations (i.e. the number of undulations per linear inch) can be varied as desired to produce fold lines requiring different amounts of force and fold relief to bend.

Ury, U.S. Pat. No. 5,293,799 describes a punching and perforating cylinder and a die and anvil cylinder that are part of a computer paper processing system producing the line holes and the cross perforation in a continuous paper web. The PUNCH/PERF cylinder is mounted on an upper shaft, while the DIE/ANVIL cylinder is mounted on a lower shaft. The upper and lower shafts are rotatably engaged by a set of gears. At both ends of the PUNCH/PERF cylinder, holes are located to accept the PUNCHES. At both ends of the DIE/ANVIL cylinder, holes are located to accept the DIES. While the two cylinders are rolling together, the punches engage with the dies and form the punched line holes in the continuous paper web. The PUNCH/PERF cylinder has longitudinally formed slots, providing the space for the cross perforating blades and for the cross perforating blade clamping bars. The DIE/ANVIL cylinder has longitudinally formed slots, providing the space for the hardened anvil bars. While the two cylinders are rolling, the cross perforating blades are engaged with the anvil bars and form the cross perforation in the continuous paper web. At both ends of the cross perforating blade locking bars, holes are located to accept the punches, providing the punch hole locations in the cylinder, circumferentially. At both ends of the anvil bars, holes are located to accept the dies, providing the die hole locations in the cylinder, circumferentially. The combined punching and perforating cylinder set enables it to complete both the punching and perforating operations in a continuous paper web by only one set of rotating cylinders.

Michlin, U.S. Pat. No. 5,566,594 describes a re-rulable steel rule die frame is made from metal. Slots are cut in the metal die frame for receiving the blades of the steel rule. In one embodiment, the frame is a block of metal and the slots are cut such that the slots do not go completely through the frame. The blades are placed in the slots to form the desired cutting configuration. The edges of the blades opposite the cutting edges rest on the metal bottoms of the slots. The corners or ends of the blades are joined by welding, brazing or soldering without danger of burning the metal frame. In another embodiment, computer-directed laser beams cut precise slots in multiple layers of metal. The multiple layers are then joined together so the slots align, providing a precisely cut metal-framed steel rule die of a thickness able to withstand repeated stress. A modification of this embodiment allows the cut material to fall through the die. The desired shape is precisely cut in each frame layer, forming openings through each layer. The layers are joined together so the openings align. The steel rule blades are brazed to the metal frame layers around the perimeter of the formed opening. When the material is cut it falls through the frame. As an alternative to the openings, compressed air ejection system is used to remove the cut work piece from the die frame.

Simpson et al., U.S. Pat. No. 5,582,571 describes an apparatus and method for perforating and creasing a paperboard sheet utilizing a rotary die process. The method and apparatus employ a die rule that comprises a base adapted to be attached to a die roll of a rotary die machine, a plurality of tooth elements, and open spaces between at least some of the plurality of tooth elements. Each of the plurality of tooth elements comprises a body portion that is fixed to and extends radially outwardly from the die roll and a laterally-tapered tooth portion. Each open space is defined by lateral portions of adjacent teeth element body portions and by the base outer edge. The body portion preferably extends radially outwardly from the base so that substantially all of the tooth portion penetrates the outer surface of the paperboard, and the base outer edge extends outwardly so that it engages and creases the inner surface of the paperboard. It is also preferred that the lateral portions of the tooth element body portions are substantially perpendicular to adjacent open spaces so that perforations formed on the paperboard inner surface are substantially the same length as those formed in the paperboard outer liner.

Johnson, U.S. Pat. No. 5,676,032 describes a steel rule cutting die for cutting fixed patterns in a single or plurality of stacked material layers according to the shape of the steel rule. The invention provides for a decrease in the quantity of scrap material produced, by minimizing the amount of gap between adjacent cavities in the steel rule cutting die. Pre-sharpened steel rule is used with the cutting edge shifted to the outboard side of the cavity thus reducing the amount of compression or wedging of scrap material between adjacent cavities, and thus allowing adjacent cavities to be positioned closer to one another or to contact one another without reducing the ability to remove the scrap material after the cutting operation. Frayed scrap material can be evacuated through the base of the die by providing evacuation holes in the base substrate of the die as well as providing for evacuation of scrap material from marker notch locations along joined sections of adjacent cavities. A variety of cavity shapes can be accommodated.

Guez, U.S. Pat. No. 5,743,164 describes an automatic reconfigurable die having an array of knives, each of which is separately pivoted and extended along and about a respective longitudinal axis, to allow a desired contour to be scored and cut from a sheet material, according to a real time computer plan which is controlling the array of knives. The automatic reconfigurable die includes actuators associated with each knife to control, via information associated with a remote computer system, the extension and retraction, and orientation of the knives. The computer selects the appropriate set points for each knife in order to match the required shape/pattern of the cut by simple curve fitting methods. In this manner, a selected plurality of the knives in the array are chosen, oriented and extended in real time to score/cut the selected part.

Brayton et al., U.S. Pat. No. 5,943,9365 describes a lightweight, dimensionally stable steel rule die for cutting and scoring carton blanks having a die board containing the cutting and scoring rules which is formed of a laminated plastic construction adapted to register and coact with a steel counterplate over prolonged production runs and maintain registration within a tolerance range of about .+–.0.002 inches.

Johnson, U.S. Pat. No. 5,983,766 describes a steel rule die for cutting cloth and synthetic materials. The cutting die includes a primary substrate and a plurality of cutting units that are removably attachable to the substrate in such a manner that they are easy to adjust, remove and replace. The cutting units include secondary substrates with lengths of steel rule attached to them to form cutting cavities. Studs mounted to the primary substrate interface with tear-drop shared holes in the secondary substrates with to restrain them against motion perpendicular to the surface of the primary substrate while permitting movement of the cutting units in a horizontal plane with respect to the primary substrate. Adjustable securing rails positioned along the peripheries of the primary substrate are moved toward the fixed securing rails to restrain the secondary substrates against lateral and longitudinal motion. By moving the adjustable securing rails away from the fixed securing rails, the cutting units can be temporarily moved away from each other for cleaning scrap material therebetween. Foam can be disposed between the cutting units to minimize the possibility of scrap material becoming lodged between the cutting units, and aid in the removal of any scrap material that happens to become lodged between the cutting units.

The prior art teaches a broad range of die board constructions, however, the prior art does not teach the present system of grid construction for simplistic adaptation of a single die board for multiple uses over a broad range of applications. Prior art die cutting boards are made of wood and are constructed for a single purpose. When the job is completed, the boards are either discarded or reworked. Reworking is a time consuming process. There clearly is a need for a die cutting board that can be reused and reconfigured many time in a simplified and cost effective manner.

SUMMARY OF THE INVENTION

The present invention teaches certain benefits in construction and use which give rise to the objectives described below.

A die board assembly includes a support plate providing a plurality of through holes arranged along lines of an X-Y grid pattern. The support plate further provides a plurality of shaped apertures positioned within the support plate to a selected depth. One of the apertures is positioned between each pair of the through holes, the apertures providing aperture legs coincident with the lines of the X-Y grid. A plurality of rigid cylindrical receivers are adapted for engagement within one of the through holes and a plurality of resilient bumpers, are engaged within the cylindrical receivers for support thereof, each of the bumpers being segmented into a plurality of segments with segment spaces in separation thereof. A plurality of elongate blades each provide a working edge and in opposition thereto, an engagement edge, the engagement edge configured so as to engage a plurality of the shaped apertures and at least one of the resilient bumpers such that a terminal surface of the bumpers extends beyond the working edge of the blades relative to the support plate. Each elongate blade engages at least one of the segment spaces between the resilient bumper segments in support of the blade.

A primary objective of the present invention is to provide an apparatus and method of use of such apparatus that provides advantages not taught by the prior art.

Another objective is to provide such an invention capable of being easily adapted to various configurations.

A further objective is to provide such an invention capable of a wide range of configurations.

A still further objective is to provide such an invention capable of being made at low cost.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the present invention. In such drawings.

DETAILED DESCRIPTION OF THE INVENTION

The above described drawing figures illustrate the invention, an apparatus for die cutting paper and paperboard sheet products as is known in the art.

Figure 1:
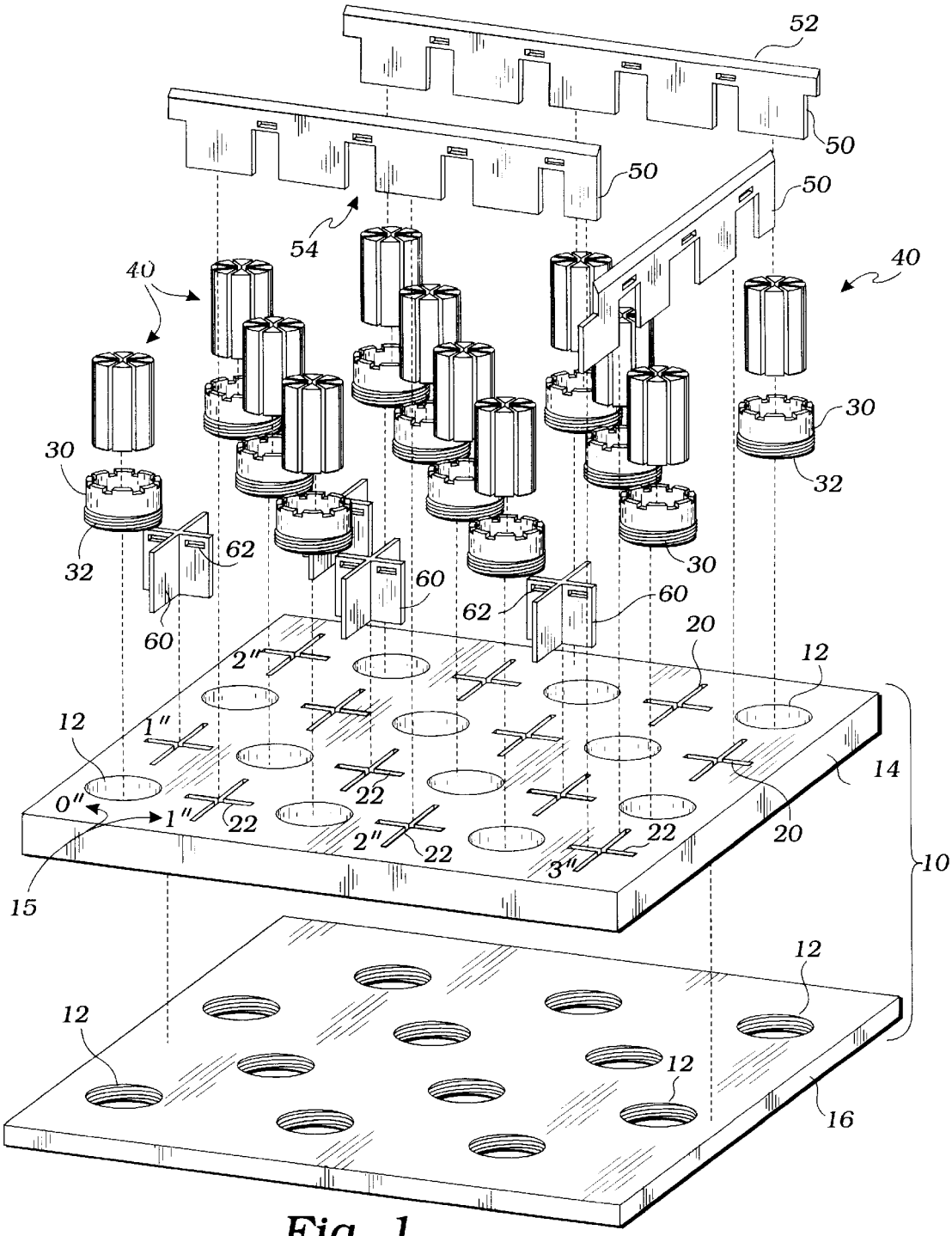
FIG. 1 is an exploded perspective view of the invention.
Figure 2:
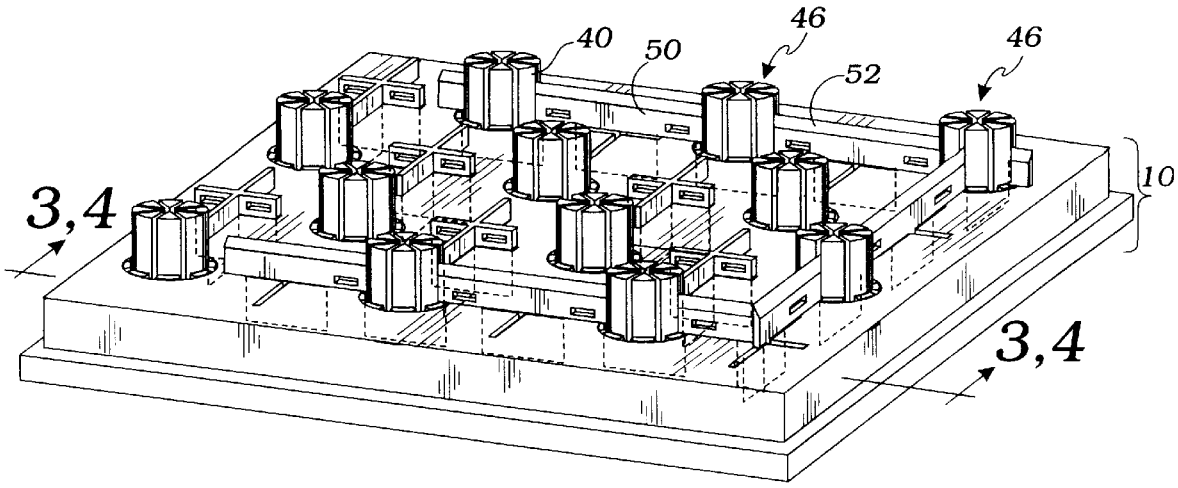
FIG. 2 is a perspective view thereof showing a wooden plate as the mounting element for the various components of the invention.
Figure 5:
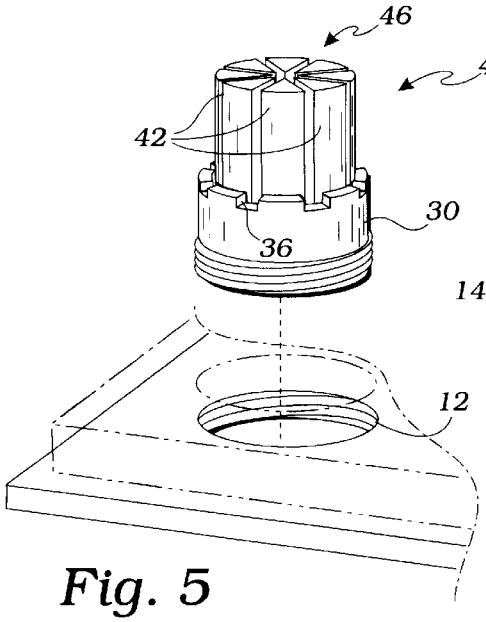
FIGS. 5 and 6 are partial views thereof showing the manner of engagement between a cylindrical receiver and a support plate thereof.

A die board assembly apparatus comprises a support plate 10, which is traditionally made of wood, providing a plurality of through holes 12 arranged along the lines of an X-Y grid, i.e., aligned in rows and columns. The support plate 10 further provides a plurality of shaped apertures 20 positioned within the support plate 10 to a selected depth, with one of the apertures 20 positioned between each pair of the through holes 12. This construction is clearly shown in FIG. 1. The apertures 20 provide aperture legs 22 aligned with the lines of the X-Y grid so that if these legs 22 were to be connected, they would bisect the holes 12. The outfacing surface is preferably adapted with dimensional indicia such as is seen in FIG. 1. A plurality of rigid cylindrical receivers 30 of metal, are each preferably, by screw threads 32, adapted for engagement with the support plate 10 within one of the through holes 12. A plurality of resilient bumpers 40, preferably of rubber, are each adapted for engagement within one of the cylindrical receivers 30 for support thereof, each of the bumpers 40 being segmented into a plurality of segments 42 with segment spaces 44 in separation thereof. This is most clearly shown in FIGS. 5 and 6. A plurality of elongate blades 50, preferably of cutting quality steel, each provide a working edge 52 and in opposition thereto, an engagement edge 54, the engagement edge 54 configured as is clearly shown in FIGS. 1 and 9, so as to engage a plurality of the shaped apertures 20, along a line, for support of the blades 50 and further engage at least one of the resilient bumpers 40 within segment spaces 44. A terminal surface 46 (top surface) of the bumpers 40 extends beyond the working edge 52 of the blades 50, relative to the support plate 10 so that the bumper 40 may perform its function as described below. Each elongate blade 50 engages at least one of the segment spaces 44 between the resilient bumper segments 42 and is therefore supported by the bumper segments 42 and in-turn support the bumpers 40 in contact therewith.

Figure 9:
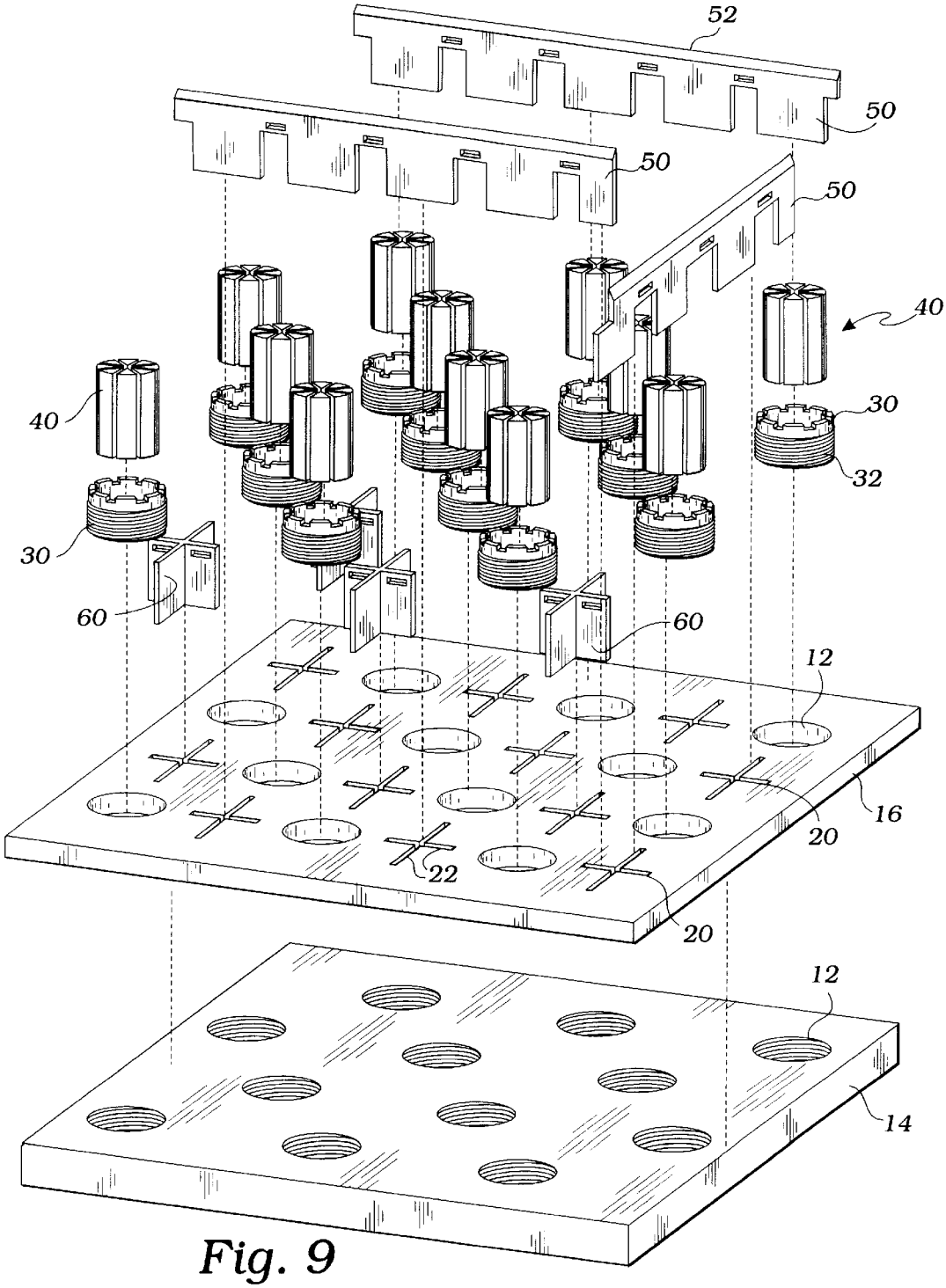
FIG. 9 is an alternative construction showing a metal plate as the mounting element for the various components of the invention.

Shaped partitions 60, made of metal, may be used wherein each of the partitions 60 is adapted by its size and shape, as shown in FIGS. 1 and 9, for engagement within one of the plurality of shaped apertures 20 when said aperture is not occupied by one of the elongate blades 50. This prevents these apertures 20 from deforming, especially when the plate 14 is made of wood, when not being otherwise used. In other words, the partitions 60 act as keepers but are removed when a blade 50 is to be used in the apertures 20 they occupy. Each of the shaped partitions 60 preferably provides at least one leveraging aperture 62 for enabling the partition to be more easily inserted and pried out of the support plate 10.

Figure 4:
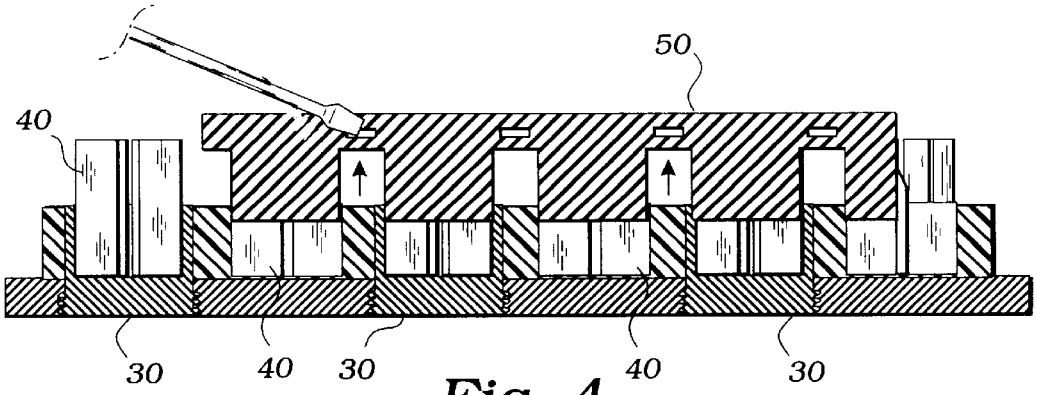

The working edge 52 of at least one of the elongate blades 50 is normally a fine cutting edge, but may also be a dull edge when used for creasing a workpiece 100 instead of cutting it. A combination of cutting and creasing edges enables a range of possible die operations and results. To facilitate insertion and removal of the blades, at least one leveraging aperture 62 is provided for prying, as shown in FIG. 4. This is highly desirable since the blades may be very sharp.

The support plate 10 is preferably comprised of two separate plates; a wooden plate 14 bonded to a metal plate 16, the metal plate 16 providing rigidizing of the support plate 14 so as to enable the assembly 10 to be used over many operations without degradation. It has been found that either of the plates 14, 16 may be used as the active plate, i.e., for receiving the various components of the invention with the wooden plate 14 shown in the receiving position in FIG. 1 and the metal plate 16 shown in the receiving position in FIG. 9.

Figure 3:
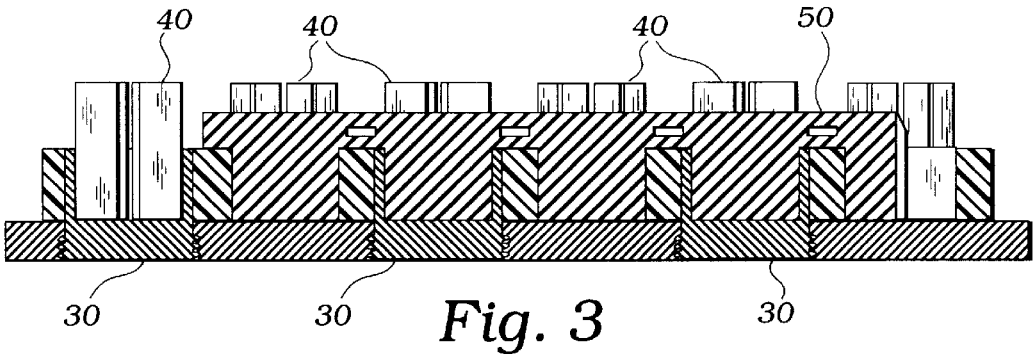
FIGS. 3 and 4 are sectional views thereof taken from FIG. 2.
Figure 6:
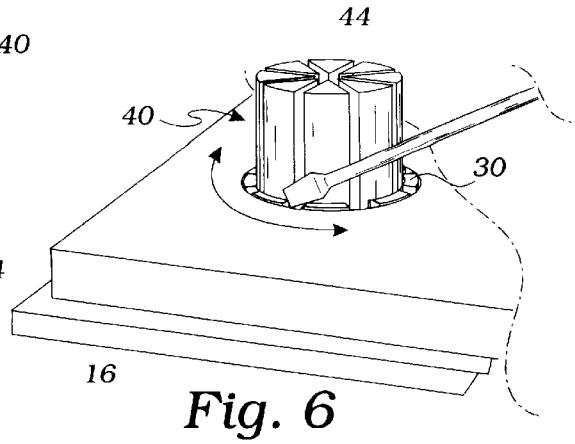

In use, the cylindrical receivers 30 having fine threads, are engaged with the treaded holes 12 in the plate 10 as is best seen in sectional views, FIGS. 3 and 4. This is achieved using a means for engagement such as notches 36 in the upper rim of the receiver, 30 as is shown in FIG. 6 for fine blade height adjustment. Each hole 12 receives one of the receivers 30.

Figure 7:
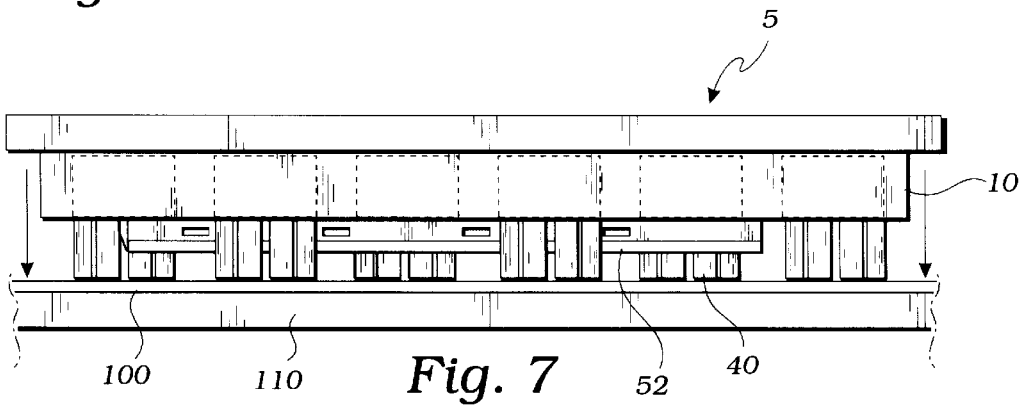
FIGS. 7 and 8 illustrate the manner in which the present invention is used.
Figure 8:
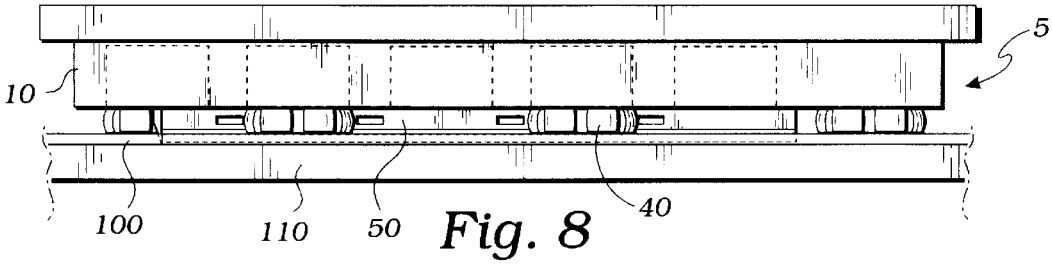

Next, the bumpers 40 are inserted into the receivers and are sized for tight fitting within the receivers 30. For improved operations, the bumpers 40 are preferably bonded into the receivers 30 and attached to the interior walls of the receivers 30. Finally, blades 50 are cut to appropriate lengths for the job at hand and then inserted into the bumpers 40 and the appropriate legs 22 of the shaped apertures 20 along the path of that is to provide cutting or creasing. An shaped partition 60 is inserted into each of the unoccupied shaped apertures 20. In FIGS. 7 and 8 we see the finished assembly in use. Notice that a workpiece 100 is in contact with a backing surface 110 for support. The present invention die cutting assembly 5 is positioned over the workpiece 100 in FIG. 7. In FIG. 8 the assembly 5 is brought into contact with the workpiece 100 whereby the bumpers 40 are deformed allowing the blades 50 to contact and penetrate the workpiece 100. As the assembly 5 is thereafter withdrawn, the bumpers 40 resume their original shape and thereby push the workpiece 100 off the blades 50. The blades 50 and bumpers 40 may be easily withdrawn from the plate 10 and reconfigured for another job. Since most jobs require positions of the blades within certain dimensional standards, the present invention is able to meet a wide range of applications.

Clearly, one may use a plurality of the boards 14 mounted in selected positions, and preferably abutting, onto the base board 12 so as to make up a wide range of possible configurations and sizes of die cutting assemblies. If the boards 12 and 14 are to be adapted for reconfiguration they may be joined by common fasteners as one of skill in the art will know.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A die board assembly apparatus comprising:

a support plate providing a plurality of through holes arranged along lines of an X-Y grid;

the support plate further providing a plurality of X-shaped apertures positioned within the support plate to a selected depth therein; one of the X-shaped apertures positioned between each pair of the through holes, the X-shaped apertures aligned as an X-Y grid;

a plurality of rigid cylindrical receivers, each of the receivers adapted for engagement within one of the through holes;

a plurality of resilient circular bumpers, each of the circular bumpers adapted for engagement within one of the cylindrical receivers, the circular bumpers each segmented into a plurality of wedge-shaped segments separated by segment spaces;

a plurality of elongate blades, each of the blades providing a working edge and in opposition thereto, an engagement edge, the engagement edge configured so as to engage a plurality of the shaped apertures and at least one of the resilient bumpers; a terminal surface of the bumpers extending above the working edge relative to the support plate, each elongate blade engaging at least one of the segment spaces between the resilient bumper segments.

2. The apparatus of claim 1 further comprising a plurality of shaped partitions, each of the partitions adapted for engagement within one of the plurality of shaped apertures when said aperture is not occupied by one of the elongate blades.

3. The apparatus of claim 1 wherein the working edge of at least one of the elongate blades is a cutting edge.

4. The apparatus of claim 1 wherein the working edge of at least one of the elongate blades is an edge enabled for creasing.

5. The apparatus of claim 1 wherein the support plate is comprised of a wooden plate bonded to a metal plate, the metal plate providing rigidizing of the support plate.

6. The apparatus of claim 5 wherein the metal plate is positioned for receiving the cylindrical receivers.

7. The apparatus of claim 5 wherein the wooden plate is positioned for receiving the cylindrical receivers.

8. The apparatus of claim 1 wherein each of the elongate blades provides at least one leveraging aperture for enabling the blade to be pried out of the support plate.

9. The apparatus of claim 8 wherein each of the shaped partitions provides at least one leveraging aperture for enabling the partition to be pried out of the support plate.

10. The apparatus of claim 1 wherein the rigid cylindrical receivers provide fine screw threads engaged with the support plate for fine blade height adjustment.

11. The apparatus of claim 10 wherein the cylindrical receivers provide means for engagement for turning the receives within the support plate.

12. The apparatus of claim 1 wherein the support plate provides an outfacing surface, the surface adapted with dimensional indicia.

* * * * *